United States Patent [19]

Tada

[11] 4,350,298

[45] Sep. 21, 1982

[54] FOAM DISPENSER

[75] Inventor: Tetsuya Tada, Tokyo, Japan

[73] Assignee: Canyon Corporation, Tokyo, Japan

[21] Appl. No.: 177,933

[22] Filed: Aug. 13, 1980

[30] Foreign Application Priority Data

| | | | |
|---|---|---|---|
| Aug. 16, 1979 | [JP] | Japan | 54/104454 |
| Sep. 5, 1979 | [JP] | Japan | 54/113987 |
| Jan. 28, 1980 | [JP] | Japan | 55/8446 |

[51] Int. Cl.[3] ..... B05B 9/043

[52] U.S. Cl. ..... 239/333; 239/343; 239/428.5; 239/504; 239/506; 239/583; 239/600; 222/380; 222/525

[58] Field of Search ..... 239/333, 343, 354, 370, 239/428.5, 503, 504, 583, 541, 600, 500; 169/14; 222/524, 525, 520, 521, 380

[56] References Cited

U.S. PATENT DOCUMENTS

| | | | |
|---|---|---|---|
| 2,766,026 | 10/1956 | Boyd | 261/76 |
| 3,777,936 | 12/1973 | Hazard | 222/525 X |
| 3,946,947 | 3/1976 | Schneider | 239/401 |
| 4,013,228 | 3/1977 | Schneider | 239/428.5 X |
| 4,020,981 | 5/1977 | Nixdartt | 222/525 |
| 4,029,299 | 6/1977 | Hechler | 366/161 |
| 4,153,203 | 5/1979 | Tada | 239/333 |
| 4,219,159 | 8/1980 | Wesner | 239/428.5 X |
| 4,227,650 | 10/1980 | McKinney | 239/333 |
| 4,274,594 | 6/1981 | Ito | 239/343 X |
| 4,277,030 | 7/1981 | Hechler | 239/428.5 X |

FOREIGN PATENT DOCUMENTS

| | | |
|---|---|---|
| 1102629 | 10/1955 | France . |
| 1018431 | 1/1966 | United Kingdom . |
| 2024049 | 1/1980 | United Kingdom . |

*Primary Examiner*—Robert B. Reeves
*Assistant Examiner*—Paul A. Sobel
*Attorney, Agent, or Firm*—Frishauf, Holtz, Goodman & Woodward

[57] ABSTRACT

A foam dispenser comprises a nozzle cap which in turn includes a bottom with which collides the spray liquid discharged from an orifice formed in a foam dispenser body. At the bottom of this nozzle cap is a plurality of arms constituting an obstacle wall with which the spray liquid from the orifice collides, and a plurality of foam outlet ports defined by adjacent arms. Therefore, scattered spray streams and freely flowing liquid streams are alternately formed adjacent to one another. Locking devices are provided to lock the nozzle cap onto the foam dispenser body to prevent it from falling off.

7 Claims, 20 Drawing Figures

FOAM DISPENSER

BACKGROUND OF THE INVENTION

The present invention relates to a foam dispenser.

A foam dispenser is already known wherein liquid sprayed from an orifice of a nozzle section of a foam dispenser body collides with the bottom of a nozzle cap located in front of the nozzle section and scatters. The scattered liquid is mixed with air supplied from an air inlet port for foaming. However, all of these known types of foam dispensers have a drawback in that it is difficult to obtain a foamed liquid of sufficient fineness since air is not adequately mixed in. For example, the Japanese Patent Disclosure No. 116,919/77 discloses a foam dispenser comprising a foam dispenser body in which is screwed a nozzle cap having a frustoconical base with an outlet port formed at its central portion. In this foam dispenser, air is supplied through a plurality of air supplying grooves formed in a male thread part of the outer circumference of the foam dispenser body. With this foam dispenser, since the central outlet port of the nozzle cap faces an orifice of a nozzle, the peripheral part of the liquid sprayed from the orifice collides with the frustoconical base and scatters. Air supplied from the air inlet port is mixed with the scattered spray liquid and with the spray liquid at the central portion of the freely flowing current for foaming. However, with such a foam dispenser, only the peripheral part of the spray liquid collides with an obstacle, that is, the bottom part of the nozzle cap, and scatters, so that the central portion of the spray liquid flows out without any interference and is not sufficiently mixed with air.

SUMMARY OF THE INVENTION

It is therefore an object of the present invention to provide a foam dispenser which eliminates these problems associated with the prior art foam dispenser.

To this end, the present invention provides a foam dispenser wherein a nozzle cap includes at its bottom part a plurality of arms constituting an obstacle wall with which the spray liquid flowing from the orifice collides, and a plurality of foam outlet ports defined by adjacent arms so that a stream of scattered spray liquid and a stream of freely flowing liquid are alternately formed adjacent to one another.

DETAILED DESCRIPTION OF THE PREFERRED EMBODIMENTS

Figure 1:
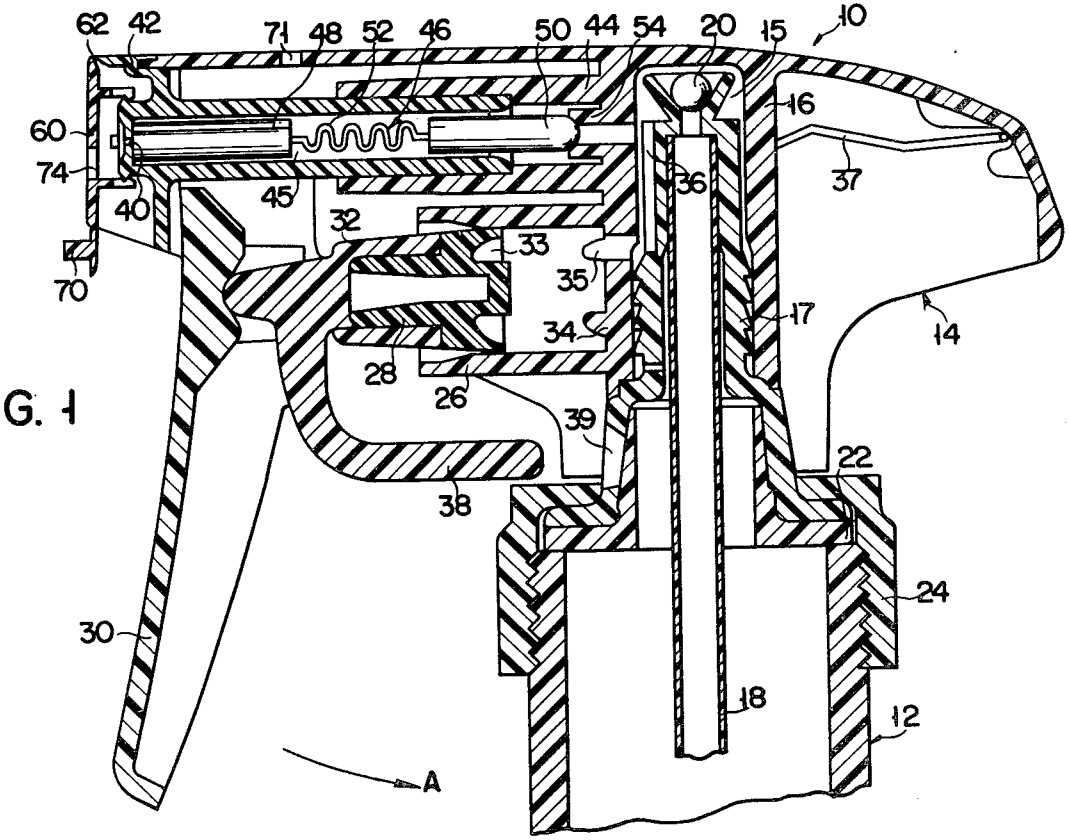
FIG. 1 is a longitudinal sectional view of a foam dispenser in accordance with the first embodiment of the present invention.

Referring to FIG. 1, a foam dispenser 10 of the present invention comprises a container 12 which receives a liquid to be foamed and a foam dispenser body 14 which is mounted to this container. A bore 15 formed in the foam dispenser body 14 receives a cylindrical valve case 16. The outer peripheral surface of the valve case 16 is provided with a plurality of parallel encircling half wave-shaped threads 17, namely, the threads, one half of whose crest portion is cut off. This arrangement causes the cylindrical valve case 16 to be easily inserted into the bore 15 but to be drawn off therefrom with considerable difficulty, thereby enabling the cylindrical valve case 16 to be securely fixed in place. A suction pipe 18 for drawing up the liquid from the container 12 is also mounted to the valve case 16. Both ends of the valve case 16 are formed in a skirtshape. The upper skirt part is used as a valve seat of a primary valve 20; and on the lower skirt is mounted a negative pressure packing 22 of an elastic material such as rubber. A tightening ring 24 is screwed to the container 12, pressing the valve case 16 and the negative pressure packing 22 toward the upper end of the container 12.

A piston 28 is slidably received in a cylinder 26 formed integrally with the foam dispenser body 14. A trigger, that is, a lever 30 is pivotably mounted to the foam dispenser body 14, and an engagement member 32, which snaps into the lever 30 to operate in cooperation therewith, clamps the piston 28. An annular groove 33 is formed in the bottom of the piston 28, and an annular projection 34 loosely engageable with the annular groove 33 is formed on the base of the cylinder 26 so that there is no free space in the cylinder and consequently no generation of air bubbles when the piston 28 is forced into the cylinder 26. A passageway 35 is bored crosswise through the projection 34 to form an inlet port and an outlet port for charging and discharging the liquid in the cylinder 26. A longitudinal groove 36 constituting a path of the liquid communicating to the passageway 35 is formed on the outer circumference of the valve case 16. A negative pressure rod 38 projects from the engagement member 32. This rod 38 is inserted in a negative pressure hole 39 of the valve case 16 when the lever 30 is pivoted in the direction A against the biasing force of a wire spring 37. Accordingly, the upper end of the packing 22 is partially separated from the valve case 16 and constitutes an air inlet port. Thus, the generation of a negative pressure in the container 12 is prevented.

A nozzle 42 with an orifice 40 formed at its front end is inserted in a cylindrical holding body 44 formed integrally with the foam dispenser body 14 above the cylinder 26 and thus constitutes part of the foam dispenser body 14. A compressed liquid flow path 45 leading from the cylinder 26 is formed inside the cylindrical holding body 44 and the nozzle 42, and a spinner assembly 46 is disposed inside the nozzle 42. The spinner assembly 46 has a spinner body 48, a cylindrical secondary valve 50 and a wave plate spring 52 stretched between the spinner body 48 and cylindrical secondary valve 50. Since these three members are integrally formed by injection molding from synthetic resin such as polypropylene, the number of parts decreases and the assembly becomes easy. By the biasing force exerted by the wavey plate spring 52 located at the center, the spinner body 48 is pressed toward the nozzle front end and the spray hole 40, while the secondary valve 50 is pressed toward a valve seat 54 formed at the base of the cylindrical holding body 44.

Figure 2:
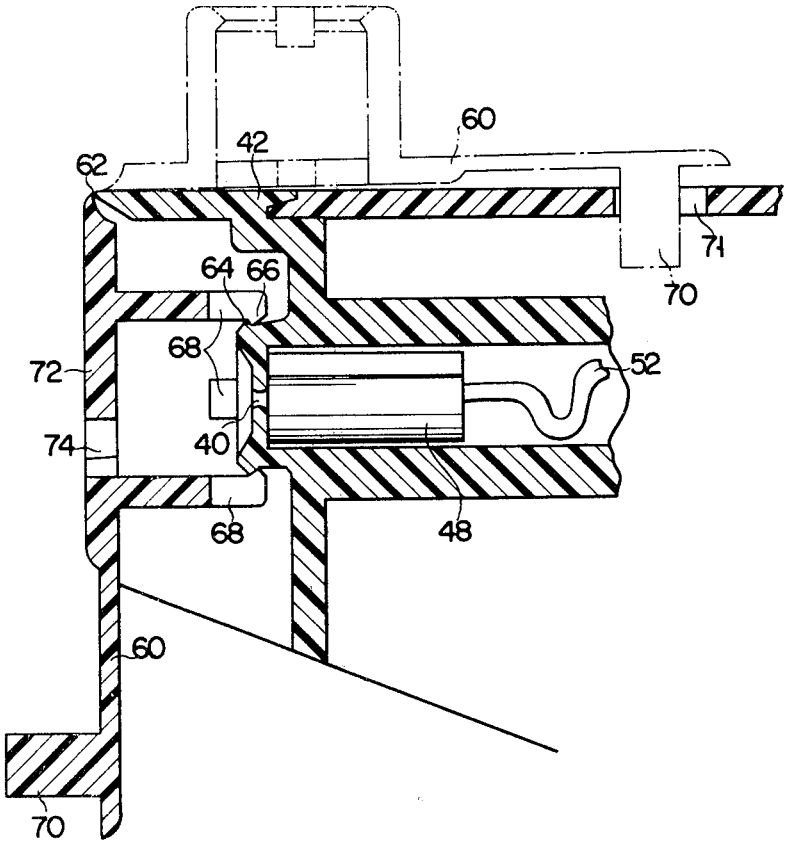
FIG. 2 is a partially enlarged longitudinal sectional view of the foam dispenser of FIG. 1.

As seen from FIG. 2, a nozzle cap 60 is formed integrally with the nozzle 42 through a hinge 62. The nozzle cap 60 is pivoted about the hinge 62 and is set at the foaming position shown by the solid line or at the spraying position shown by the broken line in FIG. 2.

The pivotable nozzle cap 60 includes an annular engaging projection 66 which detachably engages with an annular engaging projection 64 formed in the nozzle 42. These engaging projections 64 and 66 constitute a first locking means for locking the nozzle cap 60 in the foaming position. The engaging projections 64 and 66 are required only to be detachable and need not be annular. At least one slot 68 constituting an air inlet port communicates to the atmosphere. In the embodiment shown in the drawing, four slots 68 mutually separated through 90° are formed on the nozzle cap 60. A columnar engaging projection 70 is formed on the nozzle cap 60 for locking the nozzle cap 60 in the spraying position where it does not face the orifice 40 when the nozzle cap 60 is pivoted in the reverse direction from the foaming position about the hinge 62. The engaging projection 70 fits in an engaging hole 71 formed on the top surface of the foam dispenser body 14 for locking the nozzle cap 60 in the spraying position. The engaging projection 70 and the engaging hole 71 constitute a second locking means. Since the engaging part of the engaging projection 70 is the engaging hole 71 formed on the top surface of the foam dispenser body 14, it does not protrude from the top surface of the foam dispenser body 14 and therefore does not cause any inconvenience in packing the foam dispenser 10.

Figure 3:
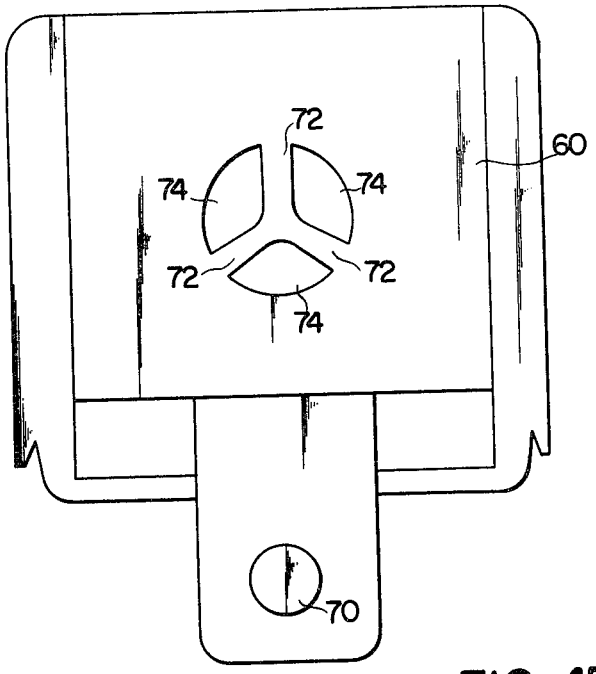
FIG. 3 is an enlarged front view of a nozzle cap.

As seen from FIG. 3, a plurality of arms 72, constituting an obstacle wall with which the spray liquid from the orifice 40 collides when the foam dispenser 10 is at the foaming position, are formed at the bottom of the nozzle cap 60. In the embodiment shown in he drawing, three arms 72 are formed, each having one common end at the center of the nozzle cap 60. These arms 72 define a corresponding number of foam outlet ports 74 between adjacent arms 72.

The spray liquid can be foamed when the lever 30 is pivoted in the direction A (FIG. 1) under the condition that, as shown in FIG. 2, the engaging projections 64 and 66 are mutually engaged so as to set the nozzle cap 60 at the foaming position. The spray liquid flowing out in a cone from the orifice 40 and whirled as in general spraying collides at its center with the connecting portion of the arms 72 and at parts of its periphery with the arms 72 and scatters. Thus, since the central portion and parts of the peripheral portion of the conical stream collide with the arms 72 and scatter, and the rest of the peripheral stream does not collide with the arms, the scattered liquid is mixed with the stream of spray liquid which did not collide as well as with air supplied through the slots 68. Thus, it flows out from the foam outlet ports 74 as a foamed liquid. Since the foam outlet ports 74 are defined by the adjacent arms 72, scattered spray and freely flowing streams are alternately formed. Thus, a sufficient amount of air is mixed in, enabling foams of sufficiently fine size to be obtained. It is, of course, to be understood that the foam dispenser is usable as a usual sprayer when the nozzle cap 60 is pivoted about the hinge 62 to engage the engaging projection 70 with the engaging hole 71 for locking the nozzle cap 60 to the foam dispenser body 14.

Figure 4A:
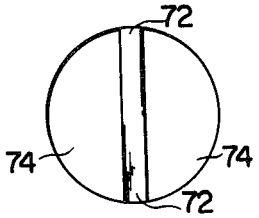
FIGS. 4A to 4C are enlarged schematic front views illustrating modifications of the arms of the nozzle cap.
Figure 4B:
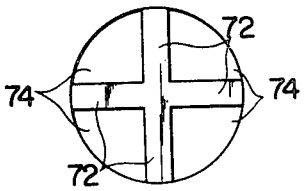
Figure 4C:
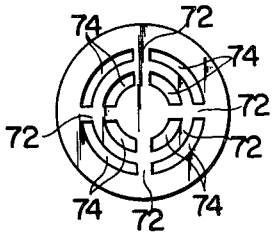
Figure 5:
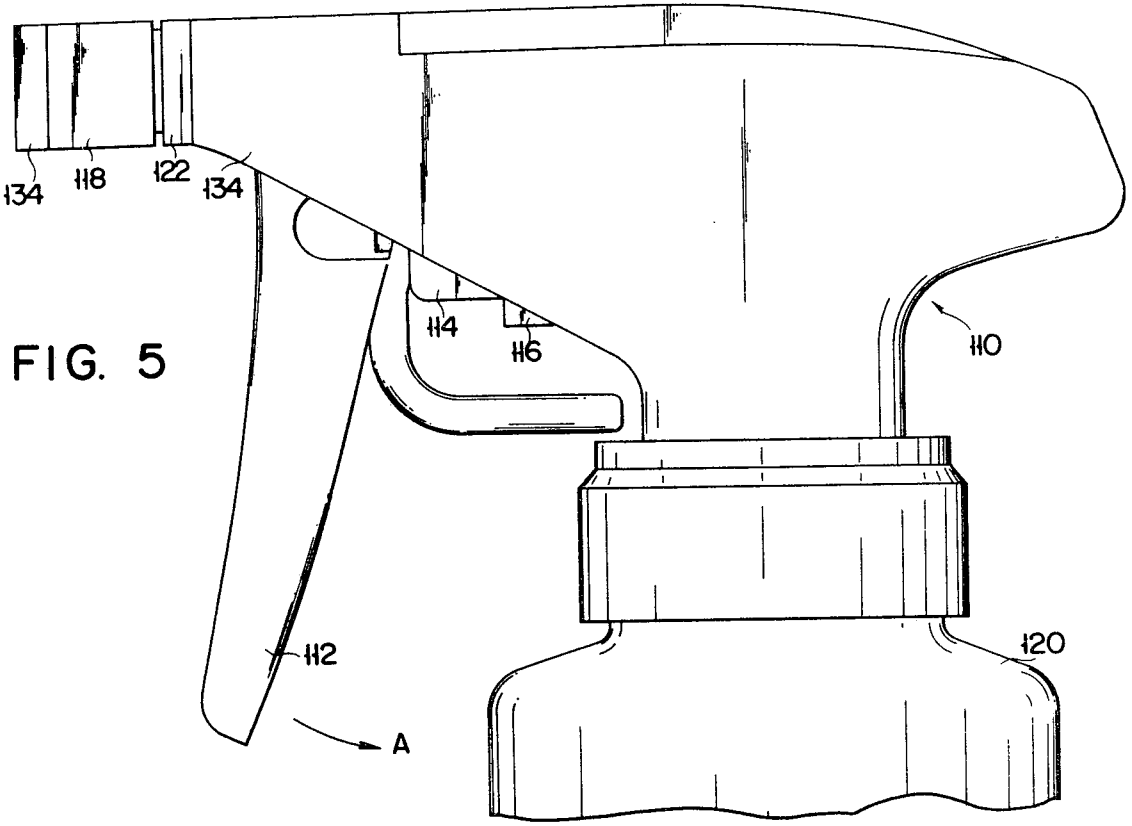
FIG. 5 is a side view in accordance with the second embodiment of the present invention.

The arrangement of the arms 72 constituting an obstacle wall with which part of the liquid stream collides is not limited to the one shown in the drawings, but may take any other form as long as the arms 72 constitute an obstacle wall and define the foam outlet holes 74 between the adjacent arms 72. For example, two arms may be formed in a straight line as shown in FIG. 4A, and four arms may be connected as shown in FIG. 4B. Further, the arms are not limited to straight arms, and straight arms and arc-shaped arms may be combined as shown in FIG. 4C. Further, the arms are generally formed symmetrically, but they are not required to be formed symmetrically. Although a connecting portion is generally formed for colliding with the central portion of the liquid stream, it need not always be formed.

As has been described, in accordance with the first embodiment of the present invention, the nozzle cap which forms part of the foam dispenser body is formed integrally through the hinge with the nozzle having the orifice, and this nozzle cap is lockable in the foaming position where it faces the orifice of the nozzle when it is pivoted about the hinge. A plurality of arms constituting the obstacle wall with which the liquid stream from the orifice collides, foam outlet ports situated between adjacent arms, and air inlet ports communicating to the atmosphere are formed in the nozzle cap. Therefore, when the nozzle cap is set in the foaming position and the liquid stream is made to flow from the orifice by a predetermined operation, part of the stream collides with the arms and scatters, while the rest of the stream flows freely without colliding with the arms. The part of the liquid stream which collides with the arms and scatters is mixed with the adjacent stream which did not collide with the arms as well as with air supplied from the air inlet ports so that foam is formed. Since the obstacle wall with which the liquid stream collides is constituted by a plurality of arms defining foam outlet ports therebetween, scattering and freely flowing streams of the stray liquid are alternately formed adjacent to one another so that sufficiently fine foams with a sufficient mixture of air are obtained.

Further, in the embodiment shown in the drawings, the spray position can be set by pivoting the nozzle cap about the hinge from the position facing the orifice of the nozzle so as to engage the engaging projection with the engaging hole. Thus, the foam dispenser can also be used as a sprayer. Further, since the nozzle cap for foaming is formed integrally with the nozzle, the nozzle cap will not be lost while the foam dispenser is used as a sprayer.

Referring to FIGS. 5 to 9, the second embodiment of the present invention will now be described. In the foam dispenser 110 of this embodiment, a lever 112 is pivoted in the direction A in FIG. 5 so as to slide a piston 114 for compressing liquid in a cylinder 116. The compressed liquid is whirled by a spinner and discharged from an orifice, and the liquid stream is foamed by a nozzle cap 118. Since the construction of the foam dispenser 110 for drawing the liquid in container 120 into the cylinder 116, compressing it inside the cylinder and discharging the liquid from the orifice is the same as in the case of the first embodiment, its description will be omitted.

Figure 6:
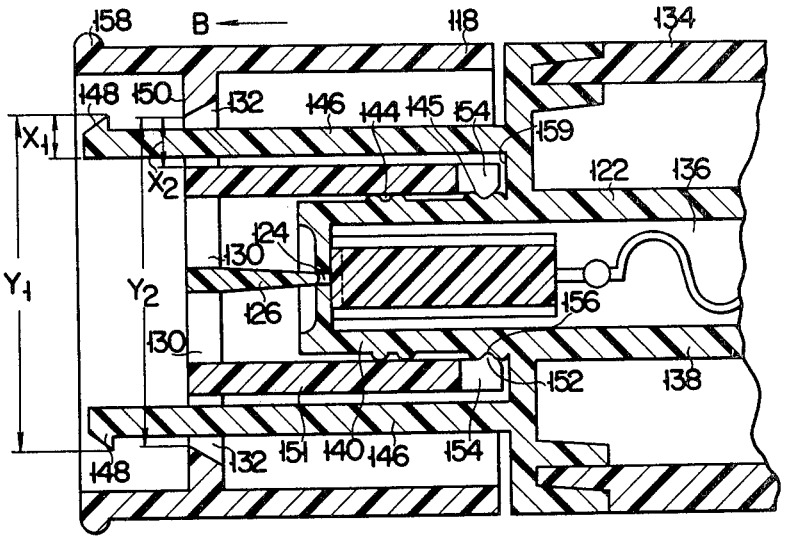
FIG. 6 is a partially enlarged longitudinal sectional view of the foam dispenser of FIG. 5.
Figure 7:
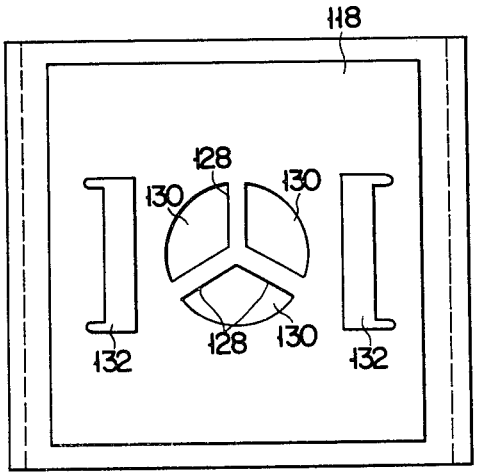
FIG. 7 is an enlarged front view of the nozzle cap.

The foam dispenser 110 is different from that of the first embodiment in construction in that it includes the nozzle cap 118 for the purpose of foaming. As shown in FIG. 6, the nozzle cap 118 includes, as a sealing member, a rod 126 which is capable of closing an orifice 124 formed in a nozzle 122. This rod 126 extends inwardly from the center of the bottom of the nozzle cap 118. A plurality of arms 128, three in this embodiment, which are connected at the center of the bottom part (FIG. 7) are formed at the bottom of the foaming nozzle cap 118, defining foam outlet ports 130 between adjacent arms 128. A pair of through holes 132 are further formed at the bottom of the nozzle cap 118.

The nozzle 122 is mounted on a foam dispenser body 134 and forms part of it. As shown in FIG. 6, the nozzle 122 includes a rear cylinder 138 extending inside the foam dispenser body 134 and having a compressed liquid path 136, and a front cylinder 140 having the orifice 124 at its front end part of the liquid path 136 inside. The front cylinder 140, as seen from FIGS. 8 and 9, has notches 142 on its upper and lower surfaces. These notches constitute air inlet ports for introducing air from the outside to the inside of the nozzle cap 118. A pair of locking grooves 144 and 145 which are separate from each other are formed on the outer circumference of the front cylinder 140. In the embodiment shown in FIG. 6, the locking grooves 144 and 145 are defined between two annular projections. However, they are not limited to these shapes, and grooves of partially circular cross section may be directly formed on the outer circumference of the front cylinder 140. The grooves 144 and 145 need not be annular, but may only partially encircle the front cylinder 140 and may be of other cross sectional shapes. A pair of cantilever arms 146 with the front cylinder 140 interposed therebetween extends out from the nozzle 122. The nozzle cap 118 is slidably mounted on the body 134 since the arms 146 are inserted in through holes 132 of the nozzle cap 118. As seen from FIG. 6, each of arms 146 has at its free end a hook-shaped locking piece 148. The locking pieces 148 are so arranged that their width $X_1$ is smaller than the width $X_2$ of the respective through holes 132, and the maximum distance $Y_1$ between both locking pieces is greater than the distance $Y_2$ between the through holes 132 as shown in FIG. 6. Thus, when the arms 146 are inserted in the through holes 132, they are deformed so that the respective free ends of the arms 146 are close to each other, and thereafter the arms 146 are returned to their original shapes. The nozzle 122 then becomes locked in place since the locking piece 148 is in contact with the front face 150 of the nozzle cap 118.

Figure 8:
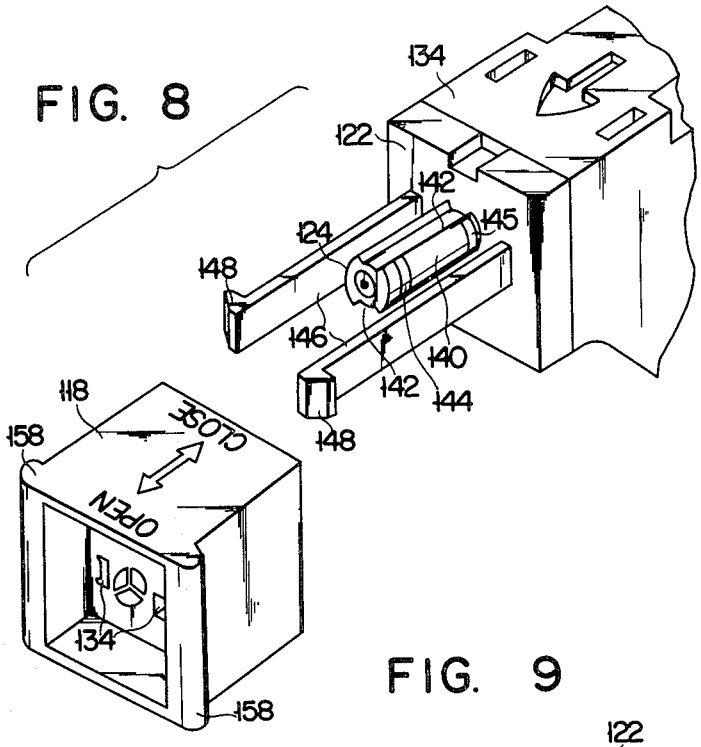
FIG. 8 is a partial perspective view corresponding to FIG. 6.
Figure 9:
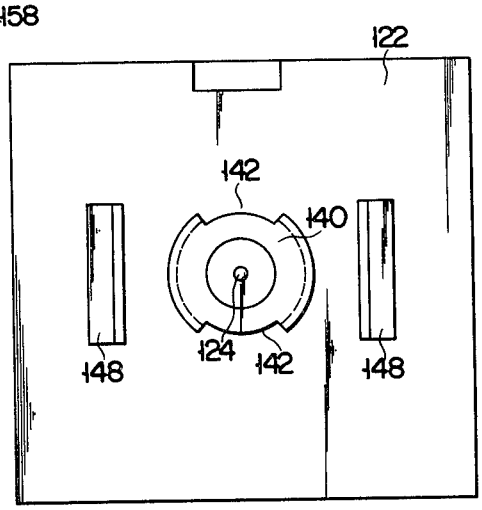
FIG. 9 is an enlarged front view of the nozzle.

The nozzle cap 118 includes an integrally formed cylinder 151 which extends inwardly from the bottom part and surrounds the front cylinder 140 of the nozzle 122. This cylinder 151 has an annular locking projection 152 at the inside of the inner end which fits with the locking grooves 144 and 145 on the outer circumference of the front cylinder 140. A pair of notches 154 constituting air inlet port are formed at the outside of the inner end of the nozzle cap 118. The locking projection 152 and the pair of locking grooves 144 and 145 constitute a locking means 156 for locking the nozzle cap 118 at the sealing position and the foaming position. At the sealing position wherein the locking projection 152 fits with the rear locking groove 145, the rod 126 of the nozzle cap 118 seals the orifice 124. At the foaming position wherein the locking projection 152 fits with the front locking groove 144, the rod 126 is separated from the orifice 124 and foaming is enabled. The nozzle cap 118 further includes a pair of holding projections 158 at the sides of its front end, as shown in FIG. 8, for facilitating the sliding movement of the nozzle cap 118. Further, although not shown in the drawings, the nozzle cap 118 may have at its sides slipping stoppers of, for example, mound shape.

The mode of operation of the foam dispenser 110 of the above-mentioned construction will now be described. As shown in FIG. 6, at the sealing position wherein the locking projection 152 of the nozzle cap 118 fits with the rear locking groove 145, the rod 126 seals the orifice 124. Thus, even if an attempt is erroneously made to pivot the lever 112 in the direction A in FIG. 5, the liquid will not flow out since the orifice 124 is closed. Thus, waste of the liquid and accidents followed by leakage of the liquid may be prevented. When the holding projections 158 are held to slide the nozzle cap 118 in the direction B in FIG. 6 and to fit the locking projection 152 with the front locking groove 144, the rod 126 is separated from the orifice 124 and foaming is enabled. When the lever 112 is pivoted at this foaming position, the liquid is whirled by a known spinner and flows from the orifice 124 in a conical stream. Since the rod 126 is located in opposition to the orifice 124, the center portion of the spray liquid flowing in a conical stream collides with the rod 126 and scatters, and part of the spray liquid at the periphery of the conical stream also collides with the arms 128 and scatters. The rest of the spray liquid at the periphery of the conical stream flows without colliding with the arms 128. The unscattered spray liquid and the scattered spray liquid are mixed, and the mixture is also sufficiently mixed with air introduced through the notches 142. The foamed liquid thus flows out of the foam outlet ports 130. Since the spray liquid is scattered and mixed sufficiently with the portion of the liquid which is not scattered and with the air, sufficiently fine foams are obtained. Since the foam dispenser 110 may be easily set at the sealing position or the foaming position by locking the slidable nozzle cap 118, the locking position of the nozzle cap at each operation is easily detected by the fingers of the operator at the holding projections 158 through the differences in the sliding resistance of the nozzle cap 118 for easy recognition. Further, if the locking projection 154 is formed at the end of the cylinder 151 as shown in FIG. 6, sufficient elasticity can be provided to the locking projection 154. Thus, a clicking sound is produced when the locking projection 154 fits in the locking groove 144 or 145, so that the locking position may be easily recognized by sound as well. If the construction is such that the sealing position can be set where the distal end of the cylinder 151 of the nozzle cap 118 contacts the front face 159 of the nozzle 122 and the foaming position can be set where the locking piece 148 of the nozzle 122 substantially contacts the front face 150 of the nozzle locking piece 148, the locking position can be made to correspond to the end of the sliding stroke and operability is improved.

In the foam dispenser in accordance with the second embodiment of the present invention, the rod which is capable of sealing the orifice formed in the nozzle extends inwardly from the center of the bottom of nozzle, a plurality of mutually connected arms are disposed at the bottom, the nozzle cap with the foam outlet ports between adjacent arms is slidably mounted to the form dispenser body, and locking means is included for locking the nozzle cap at the sealing position where the rod of the nozzle cap seals the orifice and at the foaming position where the rod is separated from the orifice. Thus, erroneous leakage of the liquid is prevented by the simple operation of sliding the nozzle cap to lock it at the sealing position so that foaming is impossible. Further, the locking means is not complex in construction since it only locks the slidable nozzle cap at a predetermined position. Thus, the locking means may, for example, includes a combination of a locking projection and a pair of locking grooves. Since a plurality of arms constitute an obstacle wall with which the spray flow collides and foam outlet ports are defined by the adjacent arms, the scattered spray and the freely flowing liquid streams are alternately formed adjacent to one another so that sufficiently fine foams are possible.

The third embodiment of the present invention will now be described with reference to FIGS. 10 to 13. In a foam dispenser 210 in accordance with this embodiment, the construction for drawing liquid from a container 220 into a cylinder 216 by pivoting a lever 212 and compressing the liquid inside the cylinder for spraying the liquid from the orifice is the same as in the first and second embodiments. Thus, description of it will be omitted.

The foam dispenser 210 has a nozzle cap 260 which is screwed to a foam dispenser body 214. The foam dispenser 210 of the third embodiment is different from those of the first and second embodiments in that the sealing position can be set by screwing this nozzle cap 260 to the innermost position; the foaming position can be set by withdrawing the nozzle cap 260 from the sealing position; and the spraying position can be set by removing the nozzle cap 260 from the foam dispenser body 214.

Figure 10:
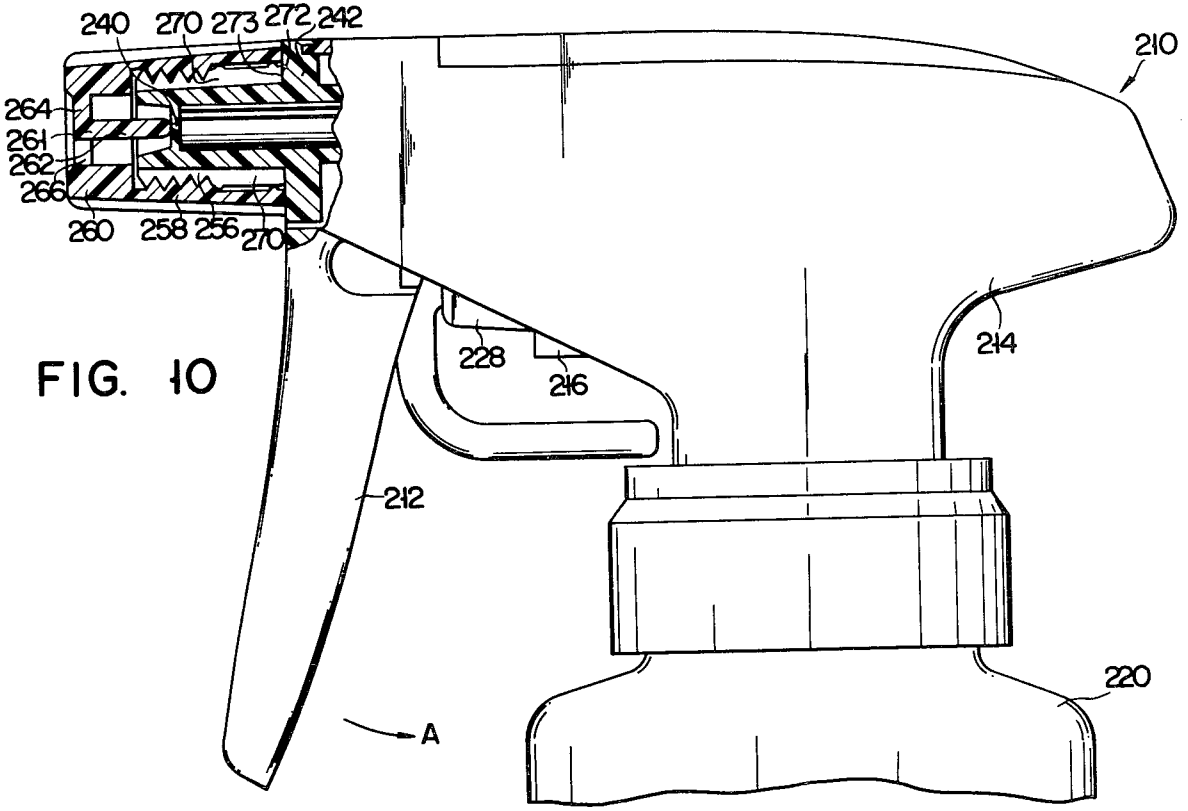
FIG. 10 is a longitudinal sectional view of a foam dispenser in accordance with the third embodiment of the present invention.
Figure 11:
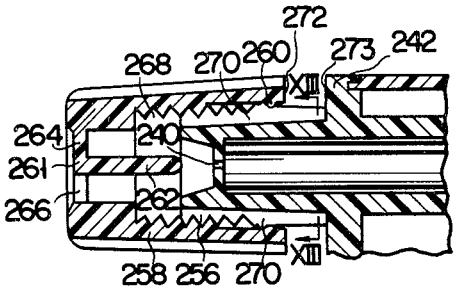
FIG. 11 is a partial vertical sectional view of the foam dispenser of FIG. 10 under the foamable condition.
Figure 12:
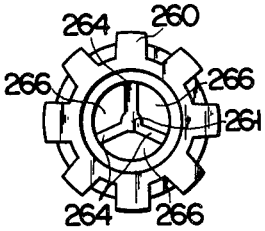
FIG. 12 is a front view of the nozzle cap.
Figure 13:
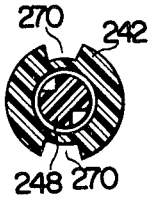
FIG. 13 is a cross-sectional view along the line XIII—XIII of FIG. 11.
Figure 14B:
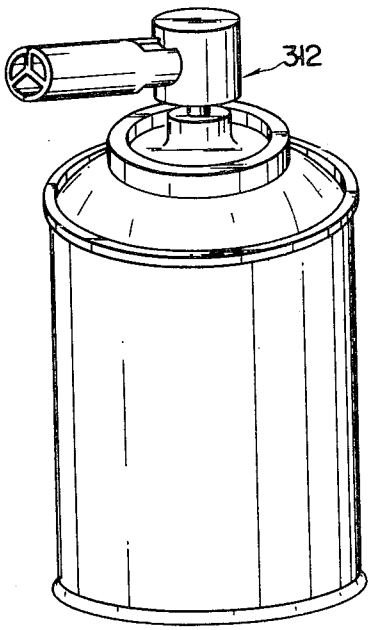
FIGS. 14A to 14E are schematic perspective views illustrating other embodiments of the present invention.
Figure 14A:
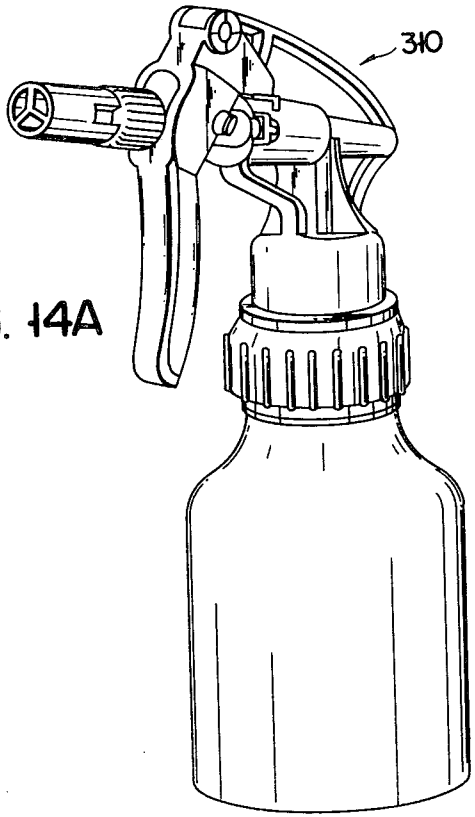
Figure 14C:
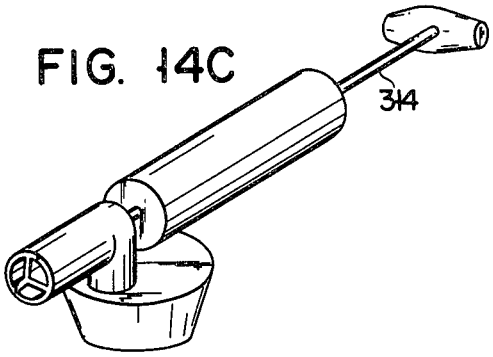
Figure 14D:
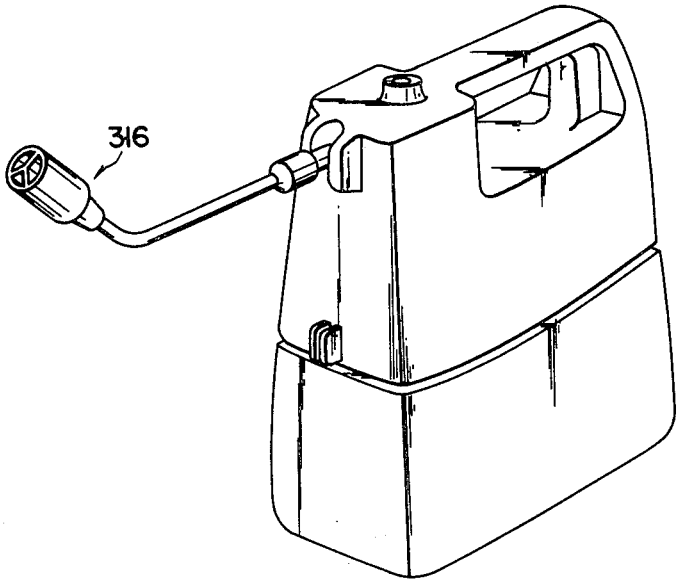
Figure 14E:
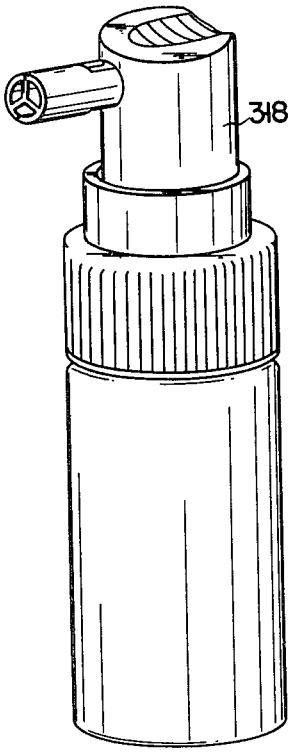

In the foam dispenser 210 as shown in FIG. 10, a male thread portion 256 is formed at the outer circumference of the front end of a nozzle 242. The nozzle cap 260 is screwed to the foam dispenser body 214 through the nozzle 242 by the engagement of this male thread portion 256 with a female thread portion 258 of the nozzle cap 260. Thus, since the nozzle cap 260 is screwed to the foam dispenser body 214, it can be displaced as shown in FIG. 11 by rotating it, and can be removed by further rotating it. The nozzle cap 260 is of cylindrical shape with a bottom 261. A rod 262 protrudes from the center of the nozzle cap 260 in opposition to an orifice 240 and is capable of sealing this orifice. As shown in FIG. 12, a plurality of arms, for example, three arms 264 are connected to the central portion of the bottom 261 of the nozzle cap 260. The spaces in the bottom formed by the adjacent arms 264 define foam outlet ports 266. Air is supplied by an air supply means. The air supply means can take various forms. For example, it may be at least one, for example, two air supply grooves 270 formed on the male thread portion 256 of the nozzle 242 (FIG. 13).

The rod 262 has a length such that it is capable of sealing the orifice 240 when the nozzle cap 260 is rotated and displaced toward the foam dispenser body 214. It thus acts as a needle valve. Thus, if the lever 212 is accidentally pivoted in the direction A in FIG. 10 when the form dispenser 210 is not in use, the liquid will not flow out of the orifice 240 since the orifice 240 is sealed by the rod 262. Thus, if the rod 262 has a length such that end face 272 of the nozzle cap 260 contacts end face 273 of the opposing nozzle 242 when the rod 262 seals the orifice 240, the orifice 240 can be sealed and at the same time the communication of the air supply grooves 270 with the atmosphere can be disconnected (FIG. 10). When the connection between the air supply grooves 270 and the atmosphere is broken, the supply of air is disabled and foaming of the liquid is prevented. In order to completely close the air supply grooves 270, an O-ring or a skirted seal is disposed at the inner face or the end face 272 of the nozzle cap 260. When the nozzle cap 260 is rotated in the direction to displace it away from the foam dispenser body 214 so as to separate the end faces 272 and 273, the communication of the air supply grooves 270 to the atmosphere is established and air is supplied as shown in FIG. 11. Under this condition, when the lever 212 is pivoted in the direction A (FIG. 10) the liquid inside the cylinder 216, compressed by the sliding movement of the piston 228, is whirled and flows out of the orifice 240 as a spray liquid. The spray liquid flowing from the orifice 240 is sprayed in a conical stream. The central portion of the liquid stream collides with the rod 262 and scatters, and part of the liquid at the periphery of the stream also collides with the arms 264 and scatters. Air supplied from the air supply grooves 270 is mixed with the scattered spray in a mixing chamber 268, and the scattered liquid mixed with air is mixed with the rest of the spray liquid at the periphery which did not collide with the arms 264. This flows from the foam outlet ports 266. Thus, since the central portion and part of the peripheral portion collide with the rod 262 and arms 264 and are scattered, air is mixed in sufficiently. When the nozzle cap 260 is further rotated in the direction to displace it away from the foam dispenser body 214 and is removed, the spray liquid from the orifice 240 does not foam and the foam dispenser can be utilized as a sprayer.

According to the third embodiment of the present invention, the rod which is capable of sealing the orifice protrudes from the center of the bottom of the nozzle cap, and a plurality of arms are formed on the bottom connected at its center, defining foam outlet ports between the adjacent arms. Thus, by sealing the orifice by the rod formed at the nozzle cap when the foam dispenser is not in use, the nozzle cap functions as a sealing cap as well, so that accidental spraying and foaming can be prevented with certainty. This rod for sealing the orifice also acts as an obstacle means for scattering the central portion of the conical liquid stream flowing from the orifice when the foam dispenser is in use. Part of the spray liquid at the periphery of the stream also collides with the arms, another obstacle means, at the bottom of the nozzle cap and is mixed with the rest of the spray liquid at the periphery of the stream. It flows out of the foam outlet ports between the adjacent arms. Thus, since the central portion and part of the peripheral portion of the conical liquid stream collide with the obstacle means and are scattered, foaming with sufficient mixture with the air is possible.

The embodiments described above are only for the purpose of understanding the principle of the present invention, and it is to be understood that any modification is included in the present invention unless it departs from the spirit and scope of the present invention. For example, in the embodiments, the foam dispenser is of the 3-way type and of trigger type; the present invention is by no means limited to this construction. For example, as shown in FIGS. 14A to 14E, the present invention is applicable to a 2-way type, trigger type foam dispenser 310, an aerosol type foam dispenser 312, a manual pumping foam dispenser 314, a dry cell type foam dispenser 316, and a push-button type foam dispenser 318.

What is claimed is:

1. In a foam dispenser for foaming a liquid mixed with air supplied from an air supplying means after the liquid is discharged from an orifice formed in a foam dispenser body and is scattered at the bottom of a nozzle cap located in front of the orifice, the improvement wherein said nozzle cap includes:

a plurality of arms at the bottom of said nozzle cap which form an obstacle wall with which the spray liquid from said orifice collides, a plurality of foam outlet ports defined between adjacent ones of said arms so that scattered spray and freely flowing liquid streams are alternately formed adjacent to one another;

a sealing member which extends from the bottom of said nozzle cap for selectively sealing off said orifice in said foam dispenser body;

said nozzle cap being movable relative to said foam dispenser body between a sealing position whereat said sealing member seals off said orifice and a foaming position whereat said orifice is not sealed so that the spray stream from said orifice may be foamed;

at least one pair of through holes formed in said nozzle cap;

and wherein said foam dispenser body includes a pair of cantilever support arms extending from said foam dispenser body and having locking means at the free end of at least one of said support arms; and said nozzle cap being slidably mounted to said pair of cantiliver support arms which respectively extend through said pair of through holes in said nozzle cap, said locking means being engageable with said nozzle cap for preventing said nozzle cap from falling off from said support arms.

2. The foam dispenser of claim 1 wherein said sealing member of said nozzle cap extends from the central portion of the bottom of said nozzle cap.

3. The foam dispenser of claim 1, wherein the nozzle cap is slidably movably mounted to said foam dispenser body for sliding movement between said sealing position and said foaming position; and said foam dispenser further includes locking means for locking said nozzle cap at said sealing position thereof and at said foaming position thereof.

4. The foam dispenser of claim 3, wherein said locking means includes a pair of locking grooves and at least one locking projection engageable therewith.

5. The foam dispenser of claim 4, wherein said foam dispenser body includes a front cylinder having said orifice therein; said locking grooves of said locking means are formed on the outer circumference of said front cylinder; said nozzle cap has a projecting member inside thereof projecting toward said front cylinder; and said at least one locking projection of said locking means is formed on the outer free end of the inner facing surface of said projecting member of said nozzle cap.

6. The foam dispenser of claim 5, wherein said nozzle cap includes a cylindrical projecting member which projects toward said front cylinder, the outer or free end of said cylinder comprising said projecting member on which said at least one locking projection of said locking means is formed, said at least one locking projection being formed on the inner facing surface of said cylinder, said cylinder surrounding said front cylinder of said foam dispenser body.

7. The foam dispenser of any one of claims 4, 5 or 6, wherein said at least one locking projection fits in the corresponding locking grooves at the starting point and the terminating point of the sliding stroke of said nozzle cap.

* * * * *